US007677405B2

(12) United States Patent
Apps et al.

(10) Patent No.: US 7,677,405 B2
(45) Date of Patent: Mar. 16, 2010

(54) CRATE FOR CONTAINERS

(75) Inventors: William P. Apps, Alpharetta, GA (US); Sean T. Ogburn, Hoschton, GA (US); Cynthia R. Meissen, Atlanta, GA (US)

(73) Assignee: Rehrig Pacific Company, Los Angeles, CA (US)

( * ) Notice: Subject to any disclaimer, the term of this patent is extended or adjusted under 35 U.S.C. 154(b) by 514 days.

(21) Appl. No.: 11/562,052

(22) Filed: Nov. 21, 2006

(65) Prior Publication Data

US 2008/0116214 A1 May 22, 2008

(51) Int. Cl.
*B65D 1/36* (2006.01)
*B65D 25/04* (2006.01)
*B65D 85/00* (2006.01)

(52) U.S. Cl. ..... 220/516; 220/513

(58) Field of Classification Search ..... 220/513, 220/515, 516, 519, DIG. 15; 206/203, 427; D3/311, 313

See application file for complete search history.

(56) References Cited

U.S. PATENT DOCUMENTS

| | | | | |
|---|---|---|---|---|
| D152,683 | S | 2/1949 | Erickson | |
| 2,597,407 | A | 5/1952 | Thompson | |
| 2,928,200 | A | 3/1960 | Shiels | |
| 3,009,579 | A | 11/1961 | Ettlinger, Jr. | |
| 3,233,804 | A | 2/1966 | Dahm | |
| 3,650,395 | A | 3/1972 | Hobbs | |
| 3,892,348 | A | 7/1975 | Rohner | |
| 3,997,057 | A | 12/1976 | Craig | |
| 4,653,651 | A | 3/1987 | Flum | |
| 4,872,560 | A | 10/1989 | Langenbeck | |
| 4,944,400 | A | 7/1990 | Van Onstein et al. | |
| 5,038,961 | A | 8/1991 | Watanabe et al. | |
| D327,972 | S | 7/1992 | Apps et al. | |
| 5,213,211 | A | 5/1993 | Umiker | |
| 5,377,862 | A | 1/1995 | Oakes et al. | |
| 5,701,994 | A | 12/1997 | Marsh | |
| 5,704,482 | A | 1/1998 | Apps et al. | |
| 5,938,011 | A | 8/1999 | Holzapfel et al. | |
| D445,253 | S | 7/2001 | Hammett | |
| 6,279,770 | B1 * | 8/2001 | Osbakk et al. | 220/519 |
| D461,054 | S | 8/2002 | Hammett | |
| D461,957 | S | 8/2002 | Hammett | |
| D535,881 | S | 1/2007 | Liukko | |

(Continued)

FOREIGN PATENT DOCUMENTS

| | | |
|---|---|---|
| CH | 568 191 | 10/1975 |

(Continued)

OTHER PUBLICATIONS

U.S. Appl. No. 12/145,932, filed Jun. 25, 2008 "Tray for Containers".

(Continued)

*Primary Examiner*—Anthony Stashick
*Assistant Examiner*—Harry A Grosso
(74) *Attorney, Agent, or Firm*—Carlson, Gaskey & Olds

(57) ABSTRACT

A crate includes a bottom wall including a plurality of dividers defining a plurality of container pockets and a peripheral wall extending upward from a periphery of the bottom wall. The bottom wall and peripheral wall are thermoformed from a single sheet of plastic, such as recycled PET bottles.

33 Claims, 18 Drawing Sheets

U.S. PATENT DOCUMENTS

| | | | |
|---|---|---|---|
| 2008/0116214 | A1 | 5/2008 | Apps et al. |
| 2008/0302691 | A1 | 12/2008 | Olson et al. |

FOREIGN PATENT DOCUMENTS

| | | |
|---|---|---|
| DE | 43 39 445 | 5/1995 |
| DE | 299 08 710 | 11/2000 |
| EP | 0531930 | 9/1992 |
| EP | 0853053 | 9/1993 |
| EP | 0696543 | 2/1996 |
| EP | 1 593 608 | 4/2005 |
| FR | 964919 | 8/1950 |
| FR | 1351218 | 12/1963 |
| GB | 145936 | 7/1920 |
| GB | 713281 | 8/1954 |
| GB | 2140393 | 11/1984 |
| GB | 2240326 | 7/1991 |
| GB | 2257121 | 1/1993 |
| GB | 2416530 | 2/2006 |
| JP | 2004-244530 | 9/2004 |
| WO | WO 99/06299 | 2/1999 |

OTHER PUBLICATIONS

U.S. Appl. No. 12/032,828, filed Feb. 18, 2008 "Crate for Containers".

International Search Report for PCT Application No. PCT/US2008/068119, Sep. 12, 2008.

International Search Report for PCT Application No. PCT/US2007/082185, Apr. 16, 2008.

* cited by examiner

CRATE FOR CONTAINERS

BACKGROUND OF THE INVENTION

The present invention relates generally to a crate for use in retaining and transporting beverage bottles or other containers.

Plastic soft drink bottles, such as two-liter PET (polyethylene terephthalate) bottles, are often packaged in crates for storage and shipment to the stores. The crates of bottles are often stacked during transportation and display at the store. Typical crates are injection molded with ribs reinforcing a bottom wall and double walls around the periphery of the bottom wall. These crates are relatively stiff and strong to improve the stackability of the loaded crates. These crates are also durable enough to be returned, washed and reused multiple times. Eventually, damaged or worn crates are recyclable. However, it is not possible or practical for the empty crates to be returned, such as in stores where the customers carry the bottles from the store in the crates.

Another common packaging for soft drink bottles is corrugated cardboard, with or without plastic wrap securing the bottles to the cardboard. The cardboard is light and inexpensive, but it is not reusable.

SUMMARY OF THE INVENTION

The present invention provides a crate that is less expensive, lighter and smaller than the current reusable crates, but unlike the cardboard packaging, is also recyclable and can be made from 100% recycled beverage bottle materials.

The crate includes a single sheet that may be thermoformed to include pockets for receiving two-liter bottles. The crate is not sufficiently strong and stiff by itself to independently support the bottles when stacked. Rather, tight tolerances between bottles and the walls of the pockets and the interaction of the hoop strength of the peripheral wall with the bottles makes the crate and bottles as a unit sufficiently strong and stiff for stacking, carrying and shipping.

Because the crate lacks the reinforcement of the known reusable crates, it is lighter and less expensive. However, the crate is also recyclable and can be molded from 100% recycled materials, such as recycled PET bottles. The crate can be thermoformed, which means that several versions can be made on the same tooling. For example, by using thermoformable sheets of higher thicknesses, a reusable crate may be formed. Thinner sheets can be formed into single-use crates.

BRIEF DESCRIPTION OF THE DRAWINGS

Other advantages of the present invention can be understood by reference to the following detailed description when considered in connection with the accompanying drawings wherein.

DETAILED DESCRIPTION OF THE PREFERRED EMBODIMENTS

Figure 1:
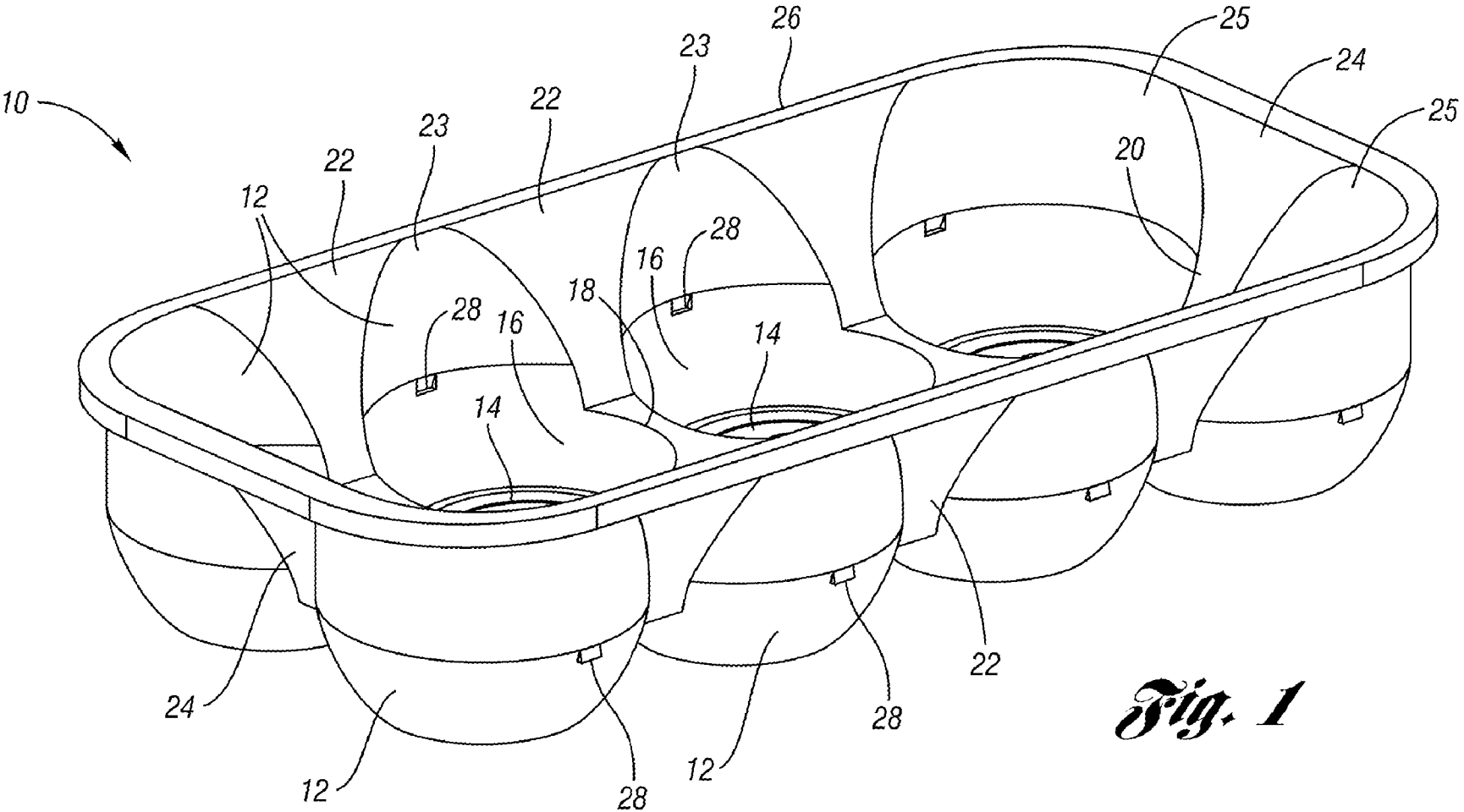
FIG. 1 is a perspective view of the crate according to one embodiment of the present invention.

A crate 10 according to a first embodiment of the present invention is shown in FIG. 1. The crate 10 is a single thermoformed sheet having a plurality of bottle-receiving pockets 12 each defined by a bottom wall 14 and a generally curved annular pocket wall 16. The pockets 12 are separated by a plurality of lateral dividers 18 and a longitudinal divider 20 in a two-by-four arrangement. Although other arrangements may be utilized, the two-by-four arrangement has been generally found to be convenient for two-liter bottles.

The crate 10 further includes alternating first upper side walls 22 and second upper side walls 23. The first upper side walls 22 are generally flat and extend upward and outward from the lateral dividers 18. The second upper side walls 23 are generally concave and further define the pockets 12.

Each end of the crate 10 further includes a generally flat first upper end wall 24 extending upward and outward from the longitudinal divider 20 and generally concave second upper end walls 25 on either side of the first upper end wall 24 to further define the pockets 12.

A peripheral lip 26 protrudes outwardly and then downwardly from the uppermost edge of the peripheral wall (formed by the first upper side walls 22 and second upper side walls 23) of the crate 10. Optional nesting stops 28 protrude outwardly from lower portions of the second upper side walls 23.

Figure 2:
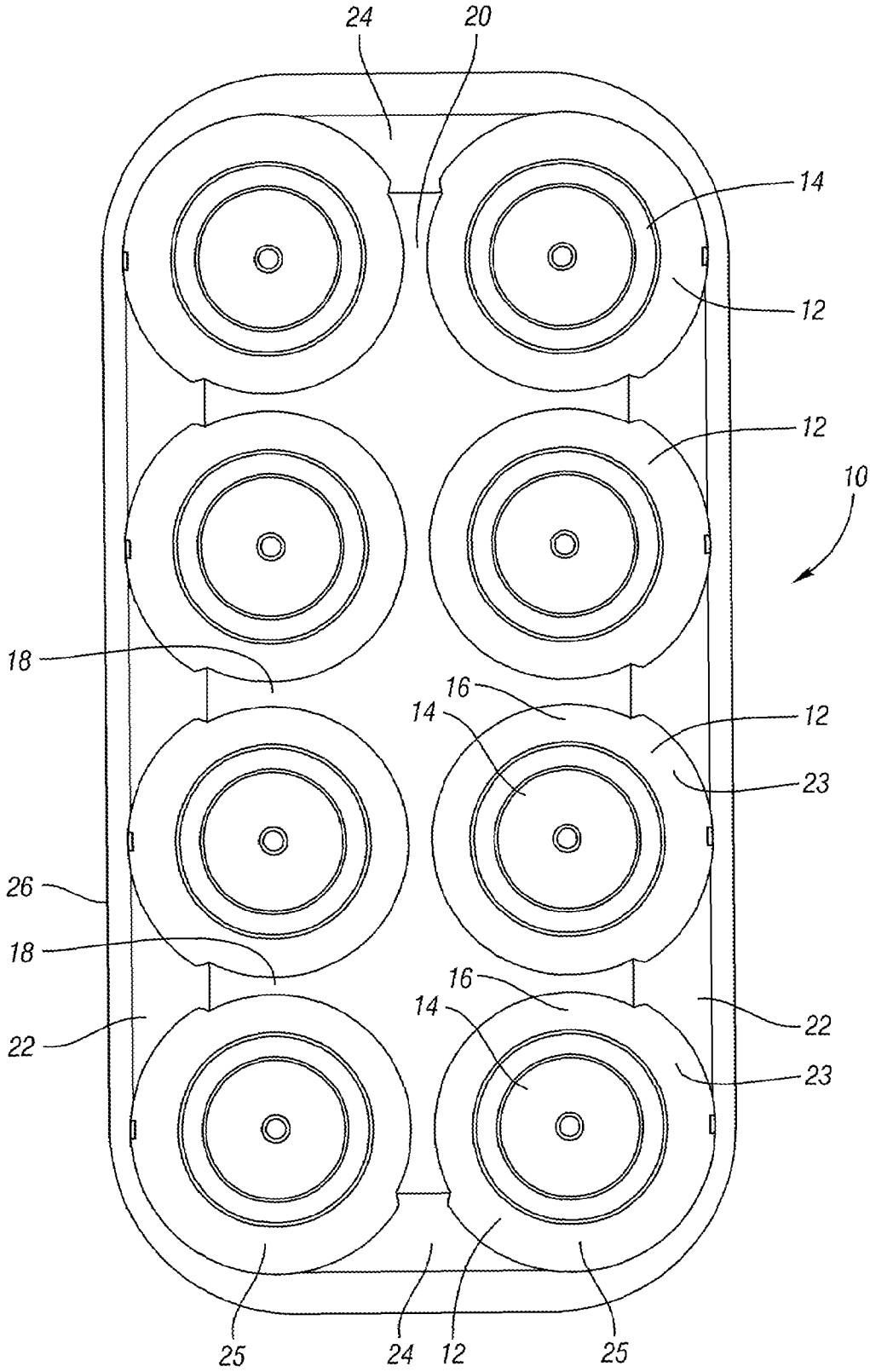
FIG. 2 is a top view of the crate of the FIG. 1.

Referring to FIG. 2, the longitudinal divider 20 extends from one first upper end wall 24 to the other. The lateral dividers 18 each extend from one of the first upper side walls 22 to an opposite first upper side wall 22. The four non-corner pockets 12 are defined by the respective bottom wall 14, the pocket wall 16 extending upward from the periphery of the bottom wall 14 and the second upper side wall 23 extending upward from a portion of the pocket wall 16. The four corner pockets 12 are additionally defined by the second upper end wall 25 extending upward from a portion of the pocket wall 16 and contiguous with the second upper side wall 23.

Figure 3:
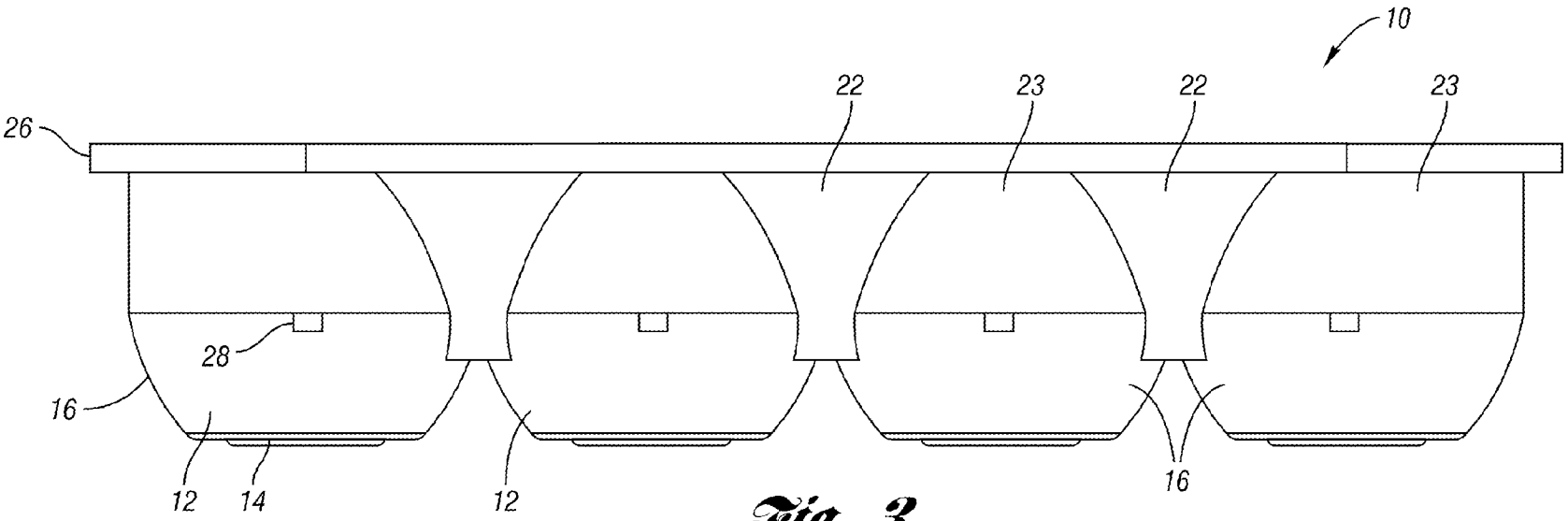
FIG. 3 is a side view of the crate of FIG. 1.
Figure 4:
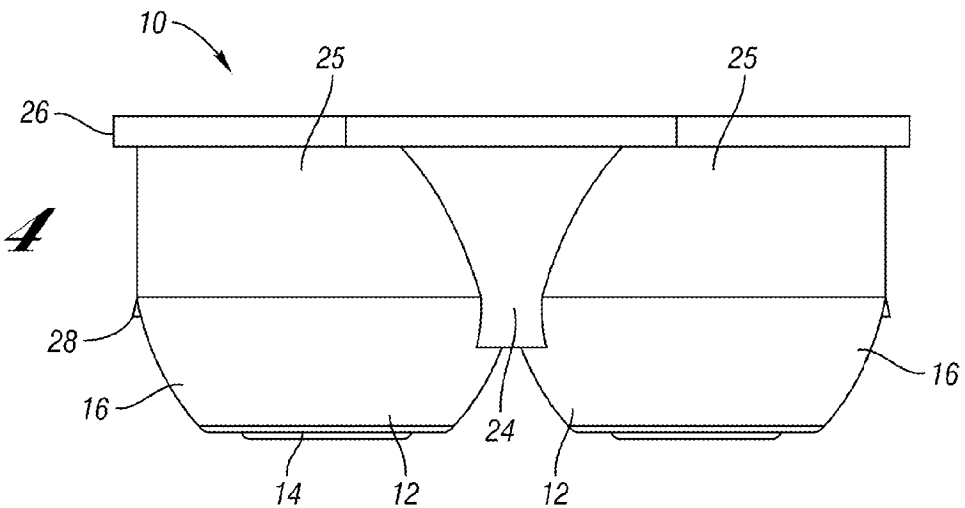
FIG. 4 is a front view of the crate of FIG. 1.

Referring to FIGS. 3 and 4, the generally annular pocket walls 16 are curved and taper down to the bottom wall 14 for each pocket 12. The peripheral lip 26 protrudes outward from the ends of the crate 10 (as seen in FIG. 3) more than the sides (as seen in FIG. 4).

Figure 5:
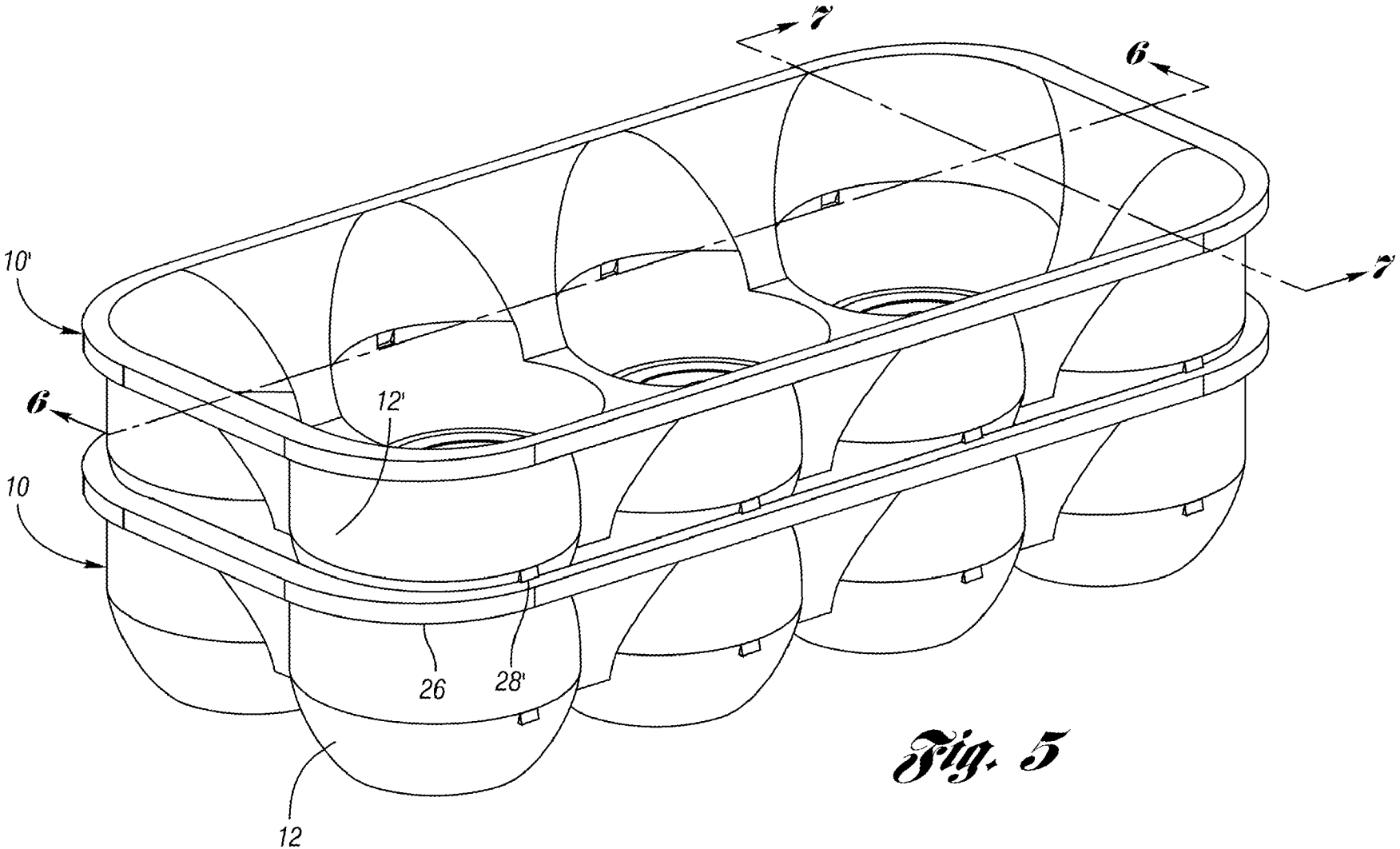
FIG. 5 is a perspective view of the crate of FIG. 1 with a similar crate nested therein.

FIG. 5 is a perspective view of the crate 10 of FIG. 1 with a similar crate 10' nested therein. The crate 10' in this example is identical to the crate 10, and corresponding reference numerals with a prime designation will be used in reference to corresponding parts. When empty, the crates 10, 10' can be nested in such a manner so that they occupy less space. The nesting stops 28' contact the peripheral lip 26 of the lower crate 10 to prevent the crates 10, 10' from nesting together too tightly so that they are hard to separate. The nesting stops 28' may not be necessary in some embodiments of the present invention.

Figure 6:
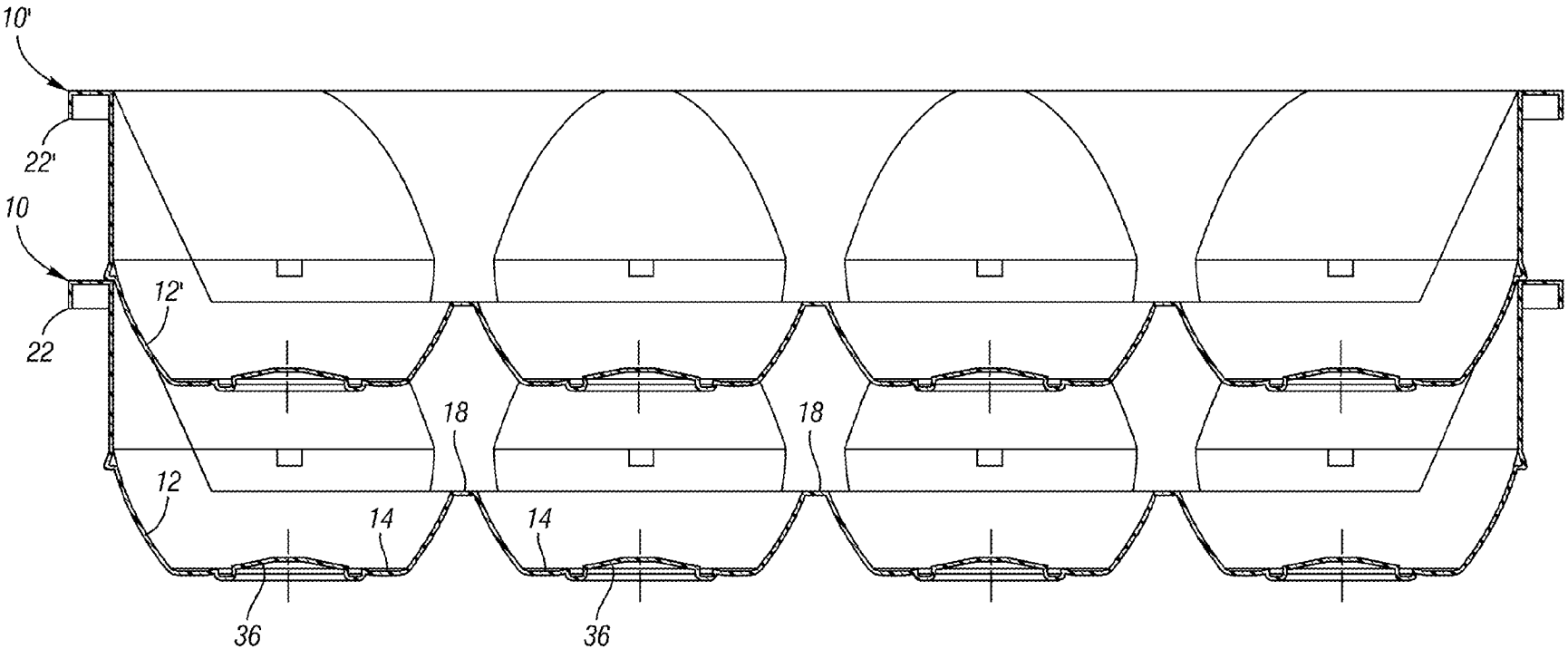
FIG. 6 is a section view taken along line 6-6 of FIG. 5.
Figure 7:
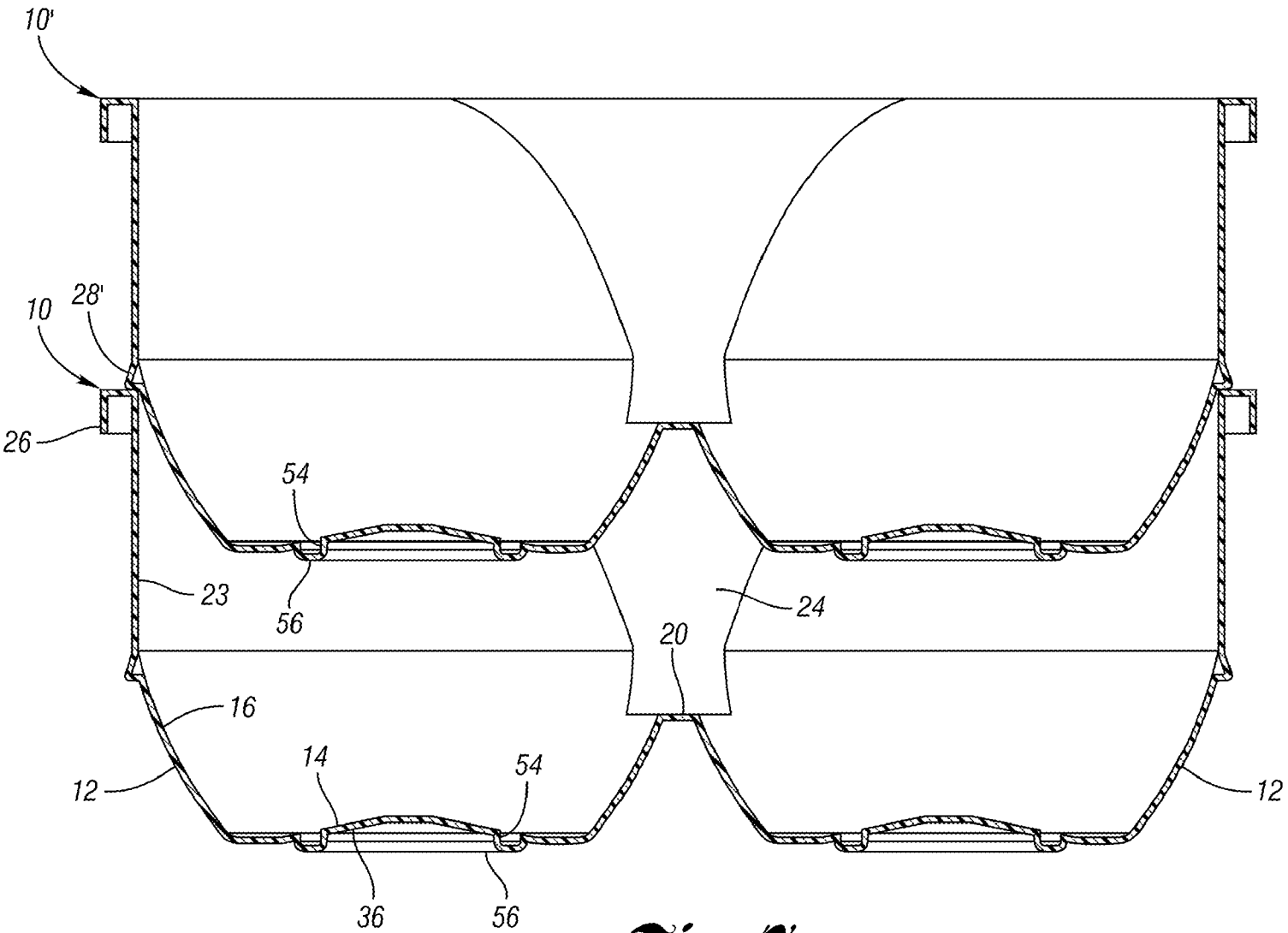
FIG. 7 is a section view taken along line 7-7 of FIG. 5.

FIG. 6 is a section view taken along line 6-6 of FIG. 5 through the nested crates 10, 10'. FIG. 7 is a section view taken along line 7-7 of FIG. 5. Referring to FIGS. 6 and 7, the overall height of the stacked crates 10, 10' is reduced by the degree to which they are nested. The bottom walls 14 each include a recess 36 on the underside for receiving a bottle cap of a bottle on which the crate 10 is stacked. The bottom walls 14 include a narrow annular recess 54, which forms an annular rib 56 on the under side of the bottom wall 14. The annular ribs 56 receive the bottle caps of the bottles on which the crate 10 is stacked.

Figure 8:
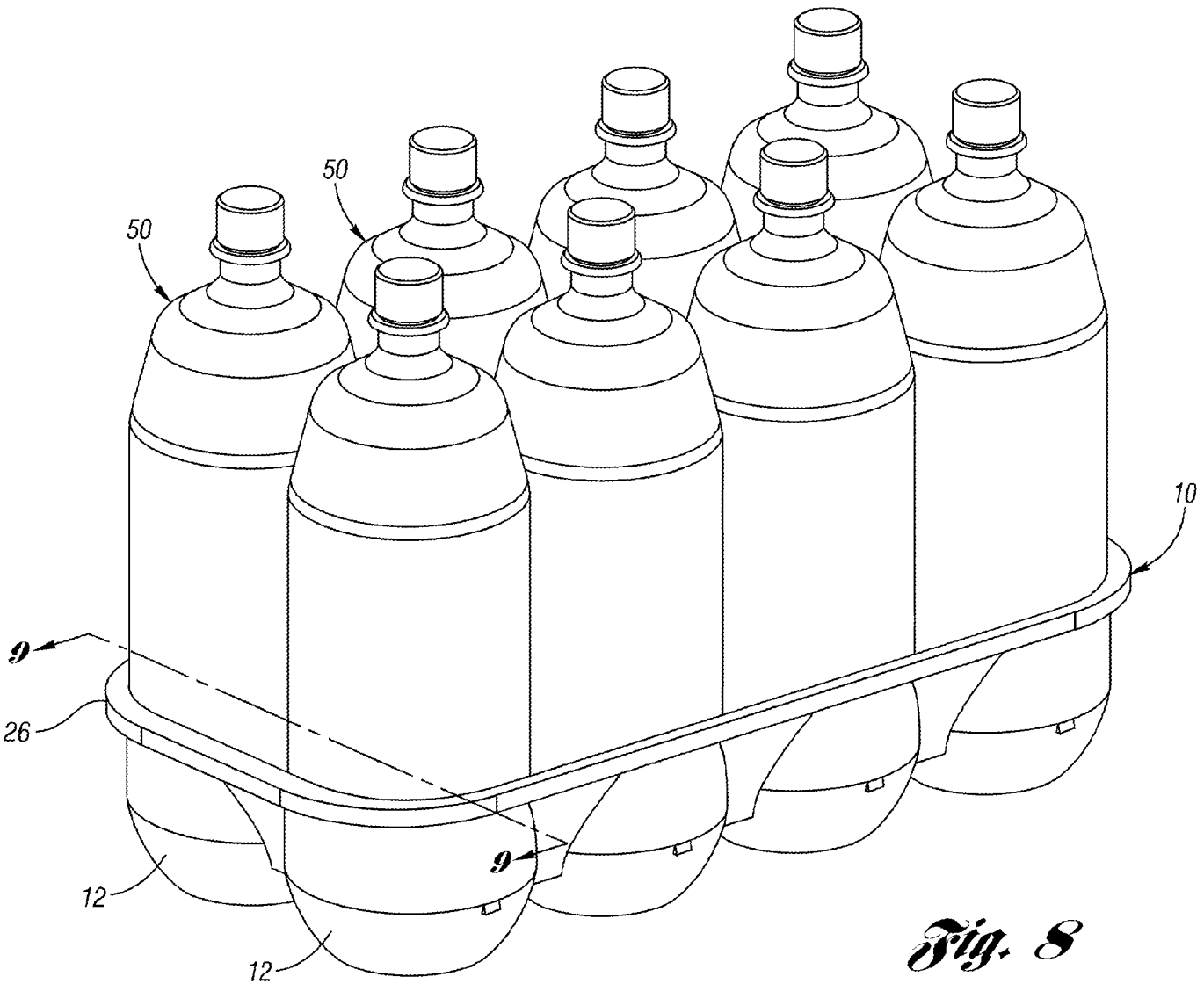
FIG. 8 is a perspective view of the crate of FIG. 1 loaded with bottles.

FIG. 8 is a perspective view of the crate 10 loaded with bottles 50, which in this example are two-liter PET bottles 50. The bottles 50 fit snugly in the pockets 12 of the crate 10 and contact one another in the crate 10. The bottles 50 are in contact with one another and are in contact with upper portions of the second upper side walls 23, particularly adjacent the portion of the second upper side wall 23 from which the peripheral lip 26 extends. The snug fit of the bottles 50 inside the crate 10 gives the crate 10 and bottles 50 as a unit the necessary stiffness for handling and stacking.

Figure 9:
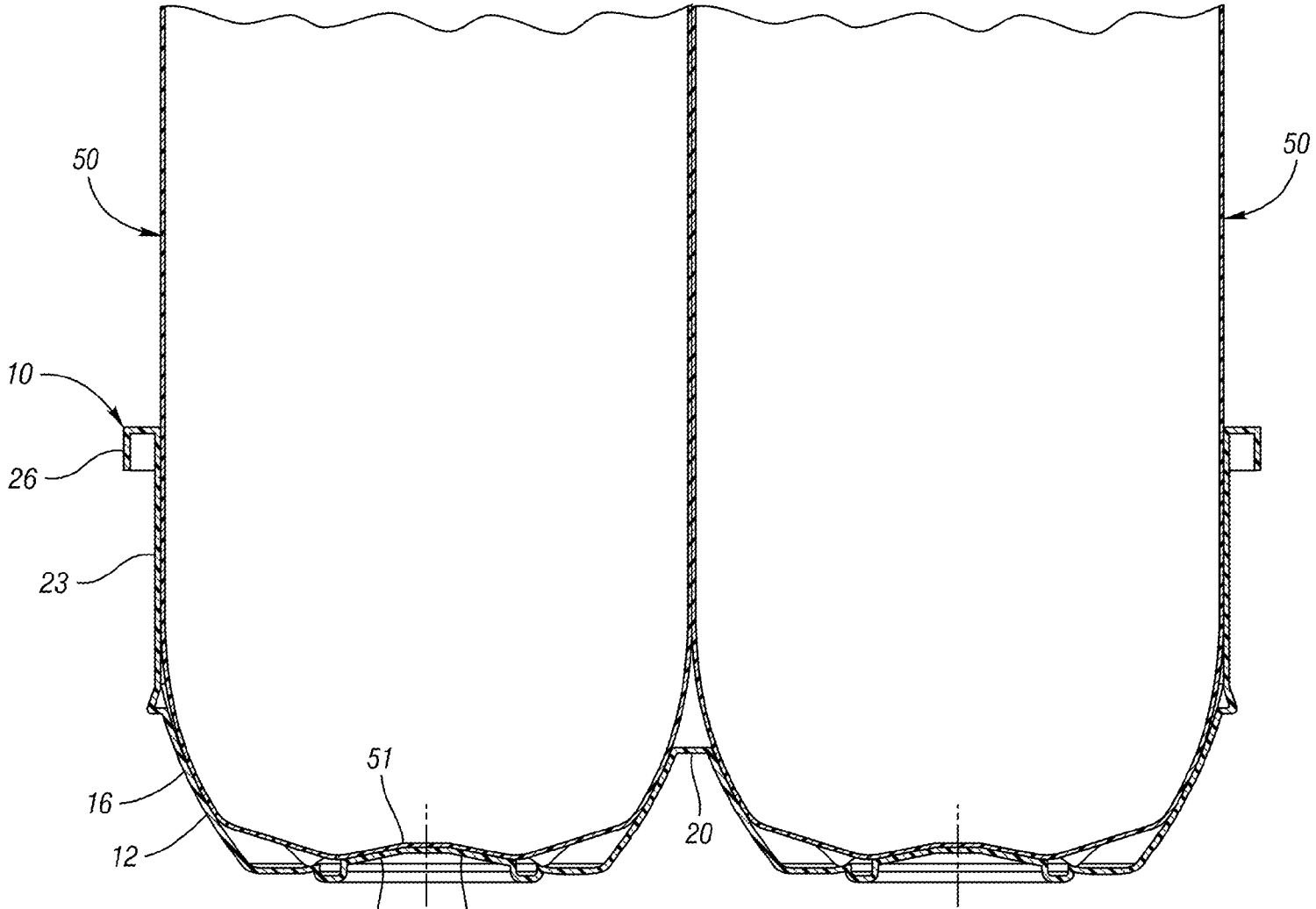
FIG. 9 is a section view taken along line 9-9 of FIG. 8.

FIG. 9 is a section view taken along line 9-9 of FIG. 8. The contours of the second upper side wall 23 and the pocket wall 16 match the walls of the bottles 50. The bottles 50 contact one another over the divider 20 (over the later dividers 18 also). The bottles 50 also contact the upper portions of the walls adjacent the peripheral lip 26. The bottom wall 14 includes an upward generally conical projection 51 that protrudes upwardly into a recess 52 in the bottom of the bottle 50. The conical projection 51 preferably mates with the recess 52 in the bottom of the bottle 50 as closely as possible, to reduce the stress that would be acting on the bottom wall 14 from the pulling (stretching) when the crate 10 is resting on a bottlecap of a bottle below, as shown in FIG. 10.

Figure 10:
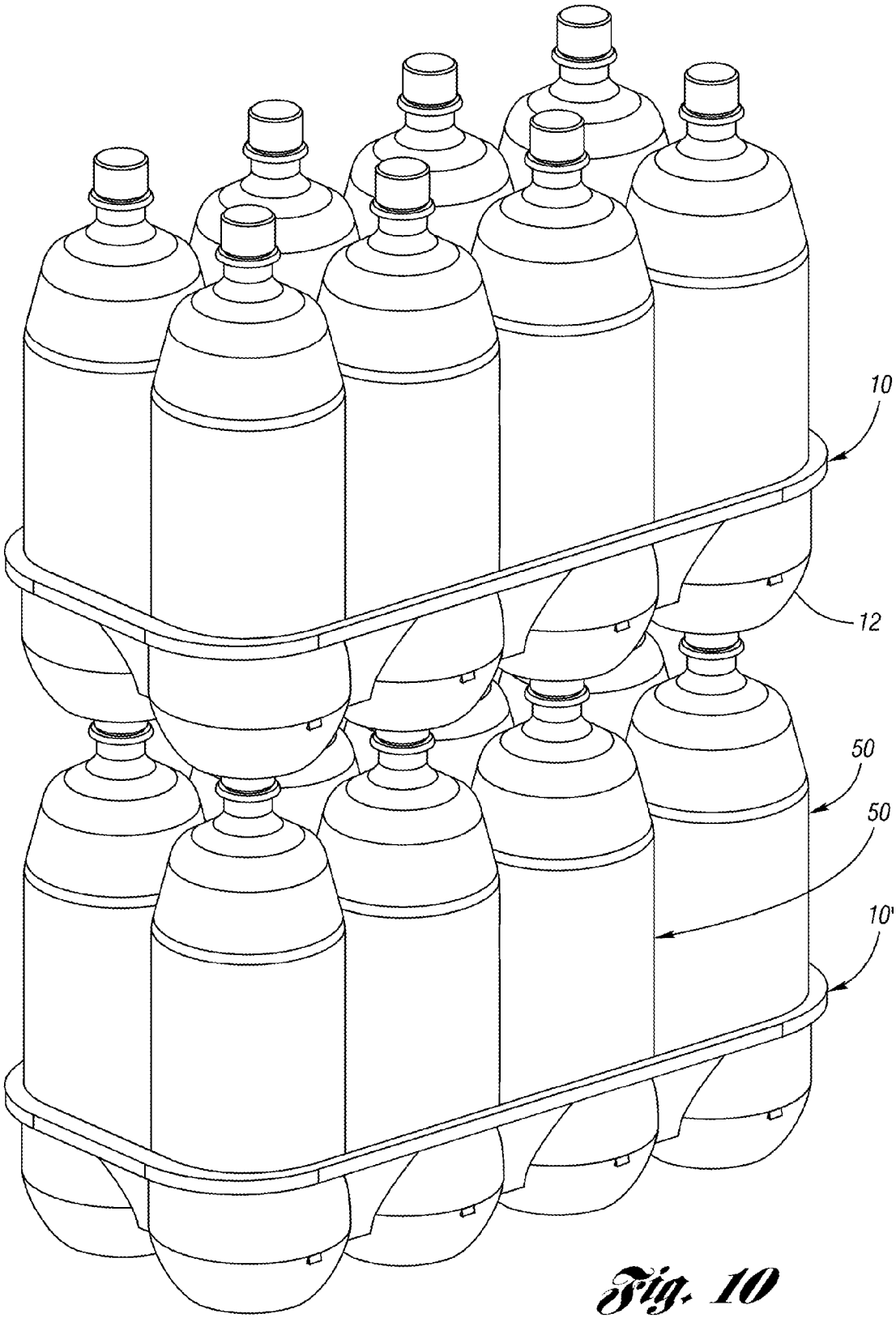
FIG. 10 is a perspective view of the loaded crate of FIG. 8 stacked on a similar loaded crate.

FIG. 10 is a perspective view of the loaded crate 10 of FIG. 8 stacked on a similar loaded crate 10'. The bottle caps of the bottles 50 are received in the recesses 36 (FIG. 9) to improve the stability of the stacked crates 10, 10'.

Figure 11:
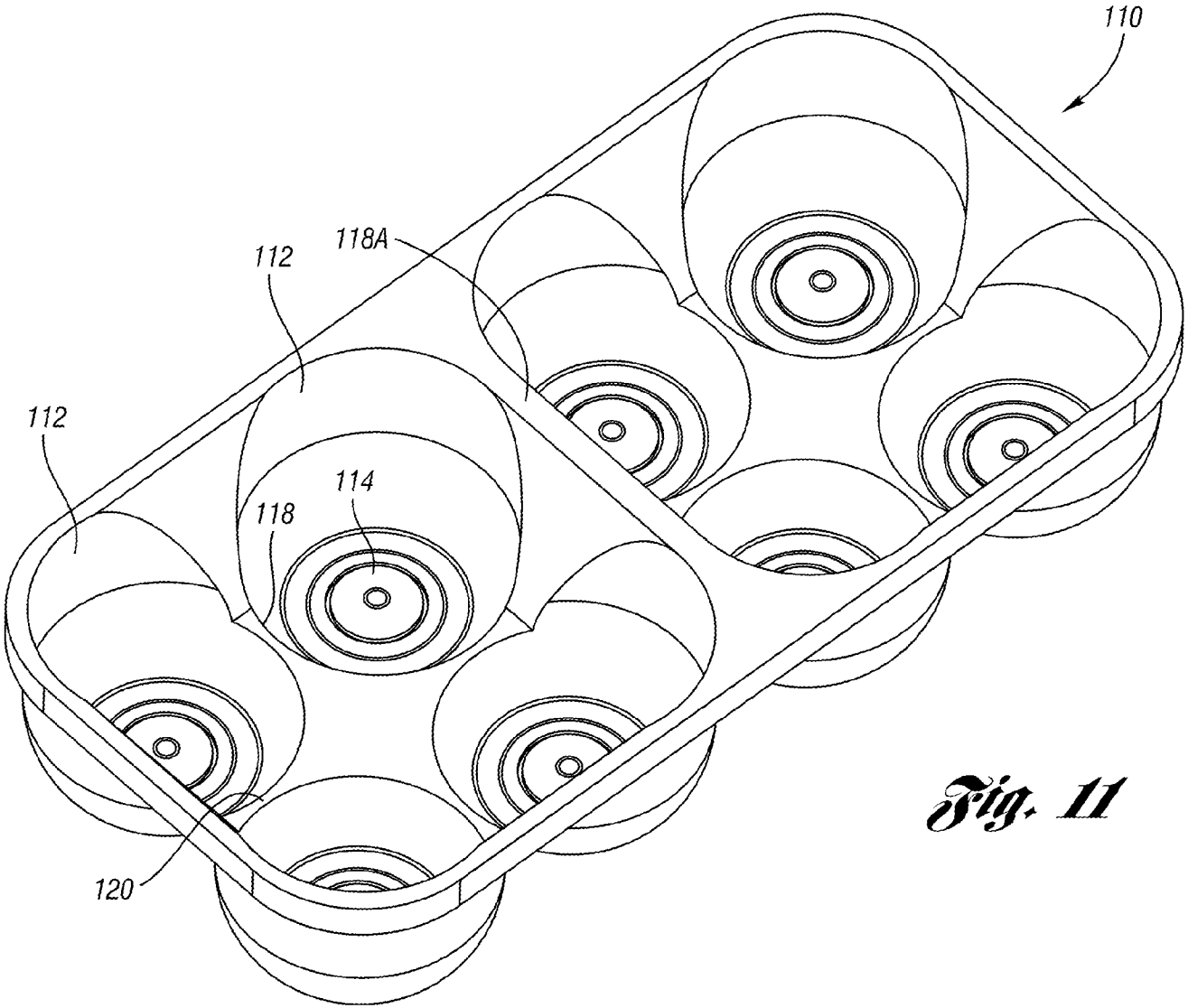
FIG. 11 is a perspective view of crate according to a second embodiment of the present invention.

FIG. 11 is a perspective view of crate 110 according to a second embodiment of the present invention. To the extent not otherwise described or shown, the crate 110 is identical to the crate 10 of FIGS. 1-10, with corresponding parts having corresponding reference numerals preappended with a "1." In this embodiment, the crate 110 includes a center lateral divider 118A that extends upward to the uppermost edge of the crate 110 to further reinforce the side walls. Thus, the crate 110 includes eight "corner" pockets 112, with the center lateral divider 118A acting as another "end wall" to the two adjacent pairs of pockets 112. Unlike the first embodiment crate 10, the bottles 50 (not shown in FIG. 11) would not directly contact one another across the center divider 118A. The upper horizontal wall portion of the center divider 118A would contact the bottles 50 in the adjacent pockets 112 to provide stability to the crate 110 when loaded.

Figure 12:
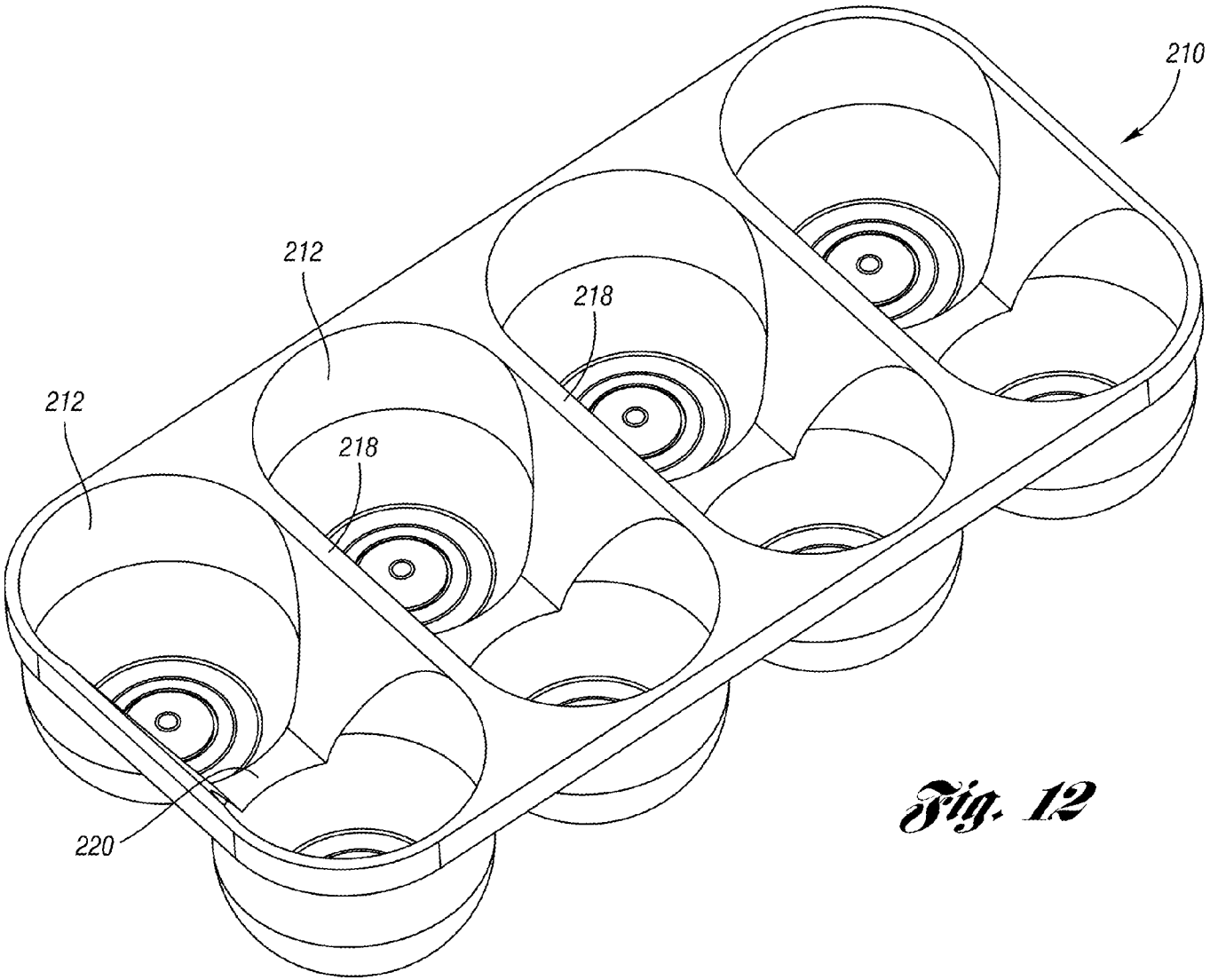
FIG. 12 is a perspective view of a crate according to a third embodiment of the present invention.

FIG. 12 is a perspective view of a crate 210 according to a third embodiment of the present invention, in which all three lateral dividers 218 extend upward to the uppermost edge of the crate 210 (like the center lateral divider 118A of FIG. 11) to further improve the stability of side walls of the crate 210.

Figure 13:
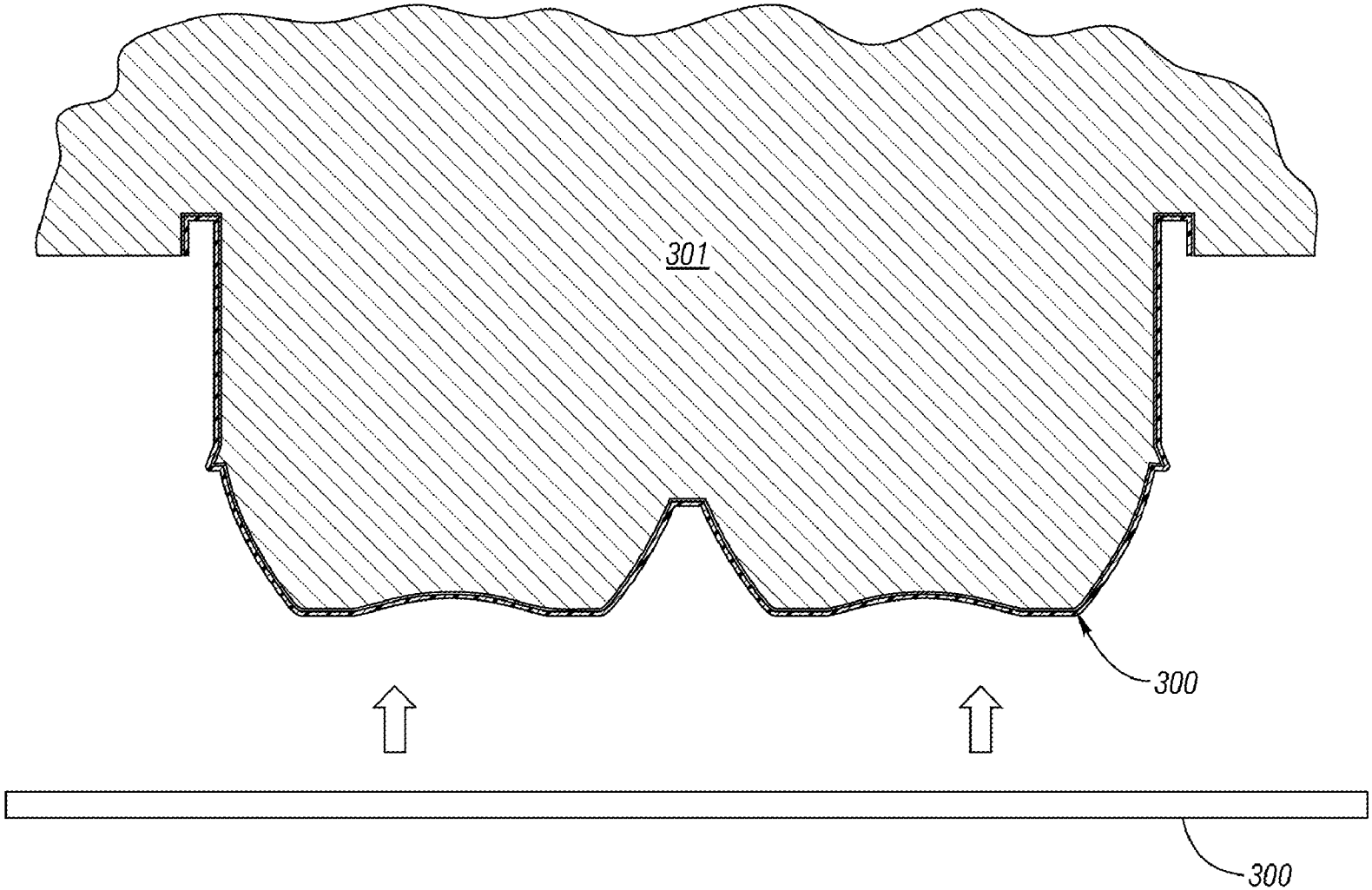
FIG. 13 is a section view of a crate being thermoformed.

Referring to FIG. 13, all three embodiments of the crate 10, 110, 210 may be formed from recycled PET bottles 50 or other plastic material. The crates 10, 110, 210 may be thermoformed on the same thermoforming form 301 from sheets 300 that are of varying thicknesses, depending on how the crates 10, 110, 210 will be used (whether the crates will be reused, the degree of stacking, etc), such as 0.040", 0.050" or 0.060". Thicker sheets 300 could be used to create a stiffer, reusable crate capable of higher stacking. As is known generally in thermoforming, the plastic sheet 300 is heated and then placed on the form 301. A vacuum may be used to draw the sheet 300 against the form 301. The formed sheet 300 is then removed (and trimmed, if necessary) to form the crate 10, 110, 210.

Figure 14:
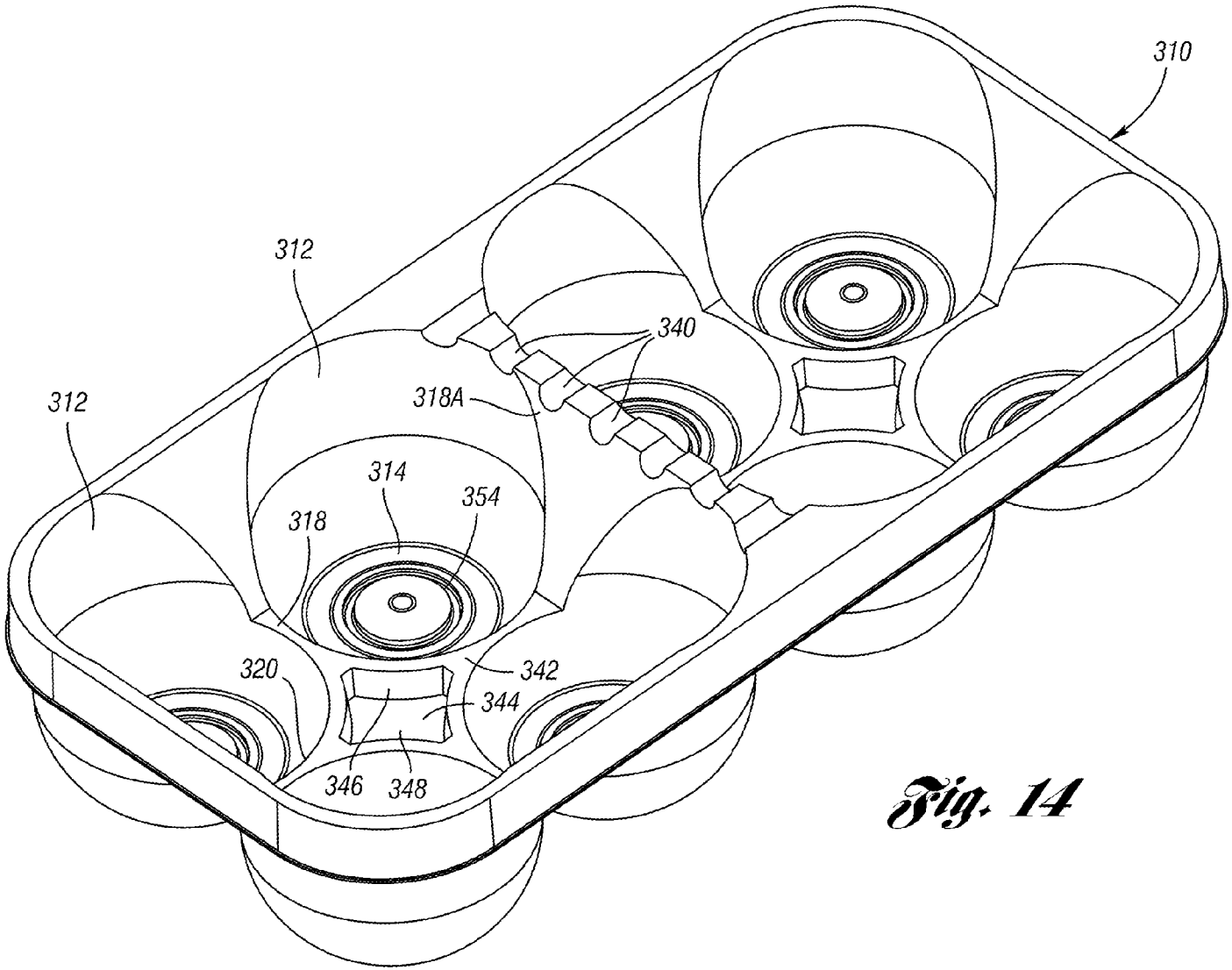
FIG. 14 is a perspective view a crate according to a fourth embodiment of the present invention.

FIG. 14 illustrates a crate 310 according to a fourth embodiment of the present invention. The crate 310 is similar to the crate of FIG. 11, except as follows. First, the center divider 318A includes a plurality of scallops 340 across the top of the divider. The scallops 340 reinforce the center divider 318A against bending about its axis (i.e. the scallops 340 prevent the four bottles on one side of the center divider 318A from pivoting about the center divider 318A relative to the four bottles on the other side of the center divider 318A).

Additionally, the diamond shaped intersection 342 between the lateral dividers 318 and the longitudinal dividers 320 each include a diamond shaped recess 344. The diamond shaped recess 344 includes substantially vertical interior peripheral walls 346 connected to a substantially horizontal bottom wall 348. The peripheral walls 346 resist bending of the crate 310 about the axis of the lateral dividers 318 and the longitudinal dividers 320.

Figure 15:
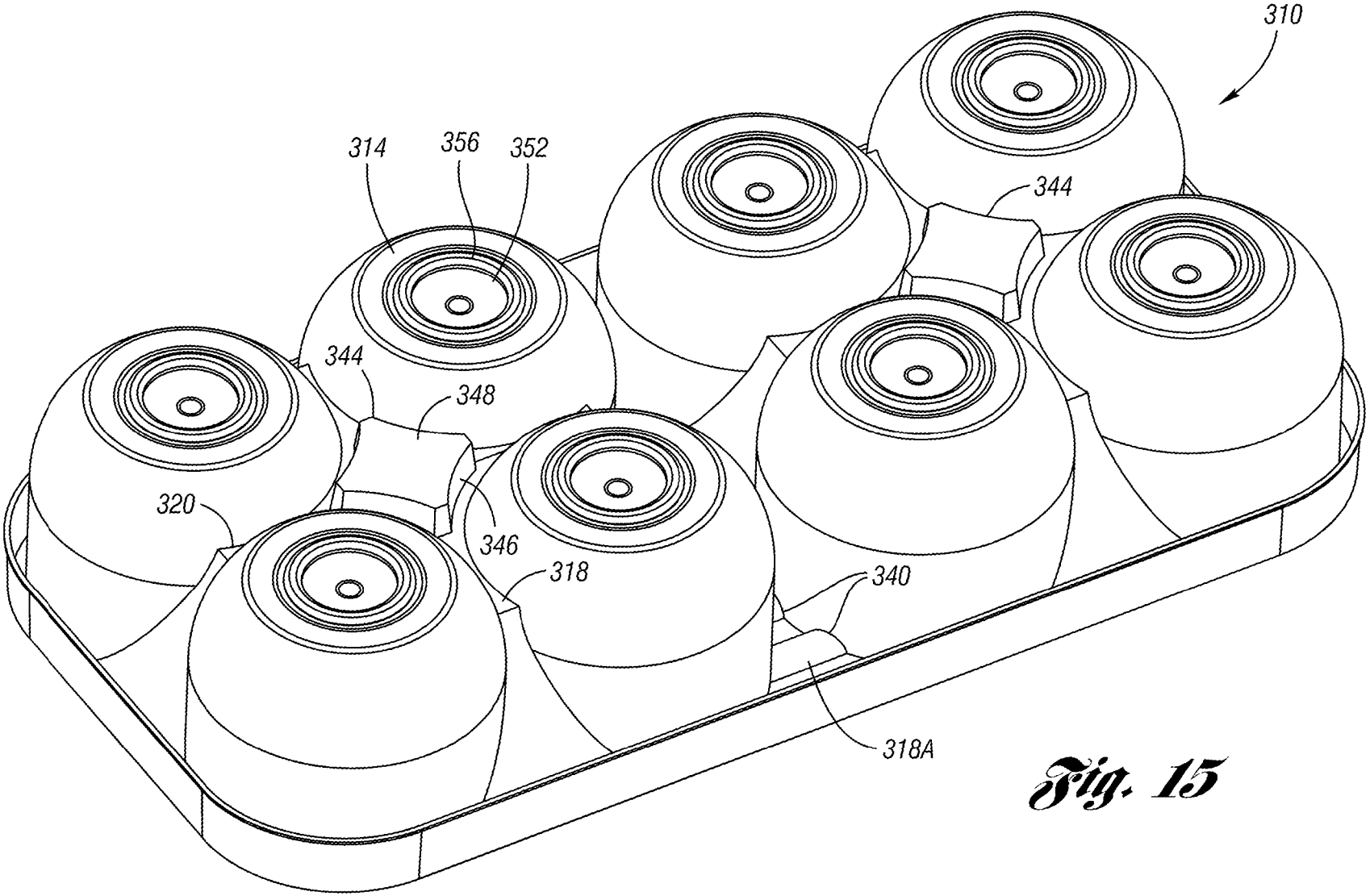
FIG. 15 is a bottom perspective view of the crate of FIG. 14.

The bottom walls 314 of the pockets 312 include a narrow annular recess 354, which forms an annular rib 356 on the under side of the bottom wall 314, as shown in FIG. 15. The annular rib 356 provides improved interlocking of the bottom wall 314 with the bottle caps of the bottles on which the crate 310 is stacked. The annular rib 356 feature may be used in any of the crates disclosed herein.

Figure 16:
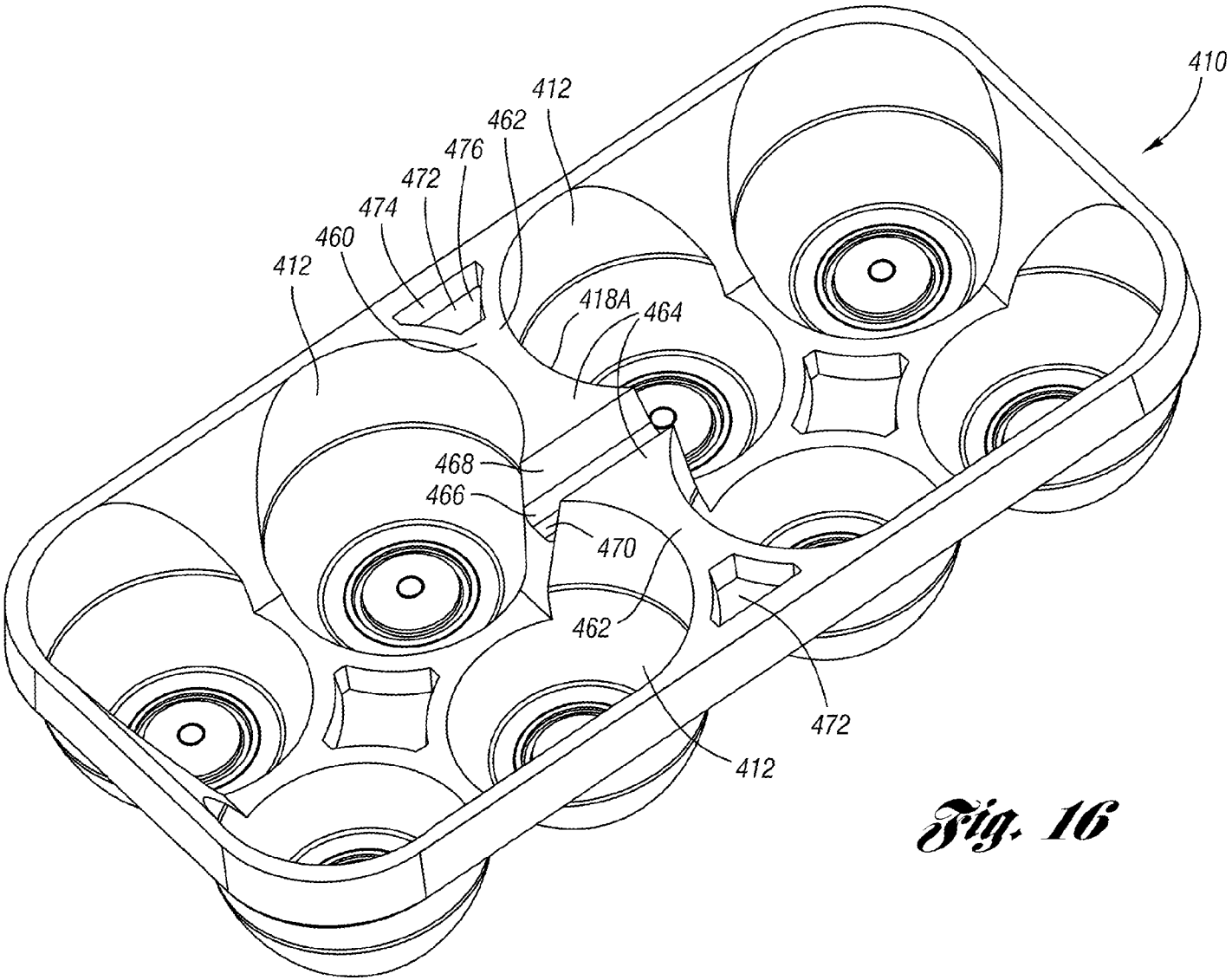
FIG. 16 is a perspective view of a crate according to a fifth embodiment of the present invention.

A crate 410 according to a fifth embodiment of the present invention is shown in FIG. 16. This crate 410 is similar to that of FIGS. 14 and 15 except as follows. The center divider 418A includes a substantially horizontal upper surface 460 that includes two narrow portions 462 and a wide center portion 464. The center portion 464 is divided by a longitudinal channel 466 defined by substantially vertical walls 468 continuous with the upper surface 460 of the center divider 418A, and a bottom wall 470 continuous with the vertical walls 468. The substantially vertical walls 468 provide even more reinforcement to the crate 410 against pivoting about the axis of the center divider 418A. The wide portion 464 of the center divider 418A provides increased contact of the center divider 418A with the bottles in the adjacent pockets 412 and permits the substantially vertical walls 468 to be longer.

Figure 17:
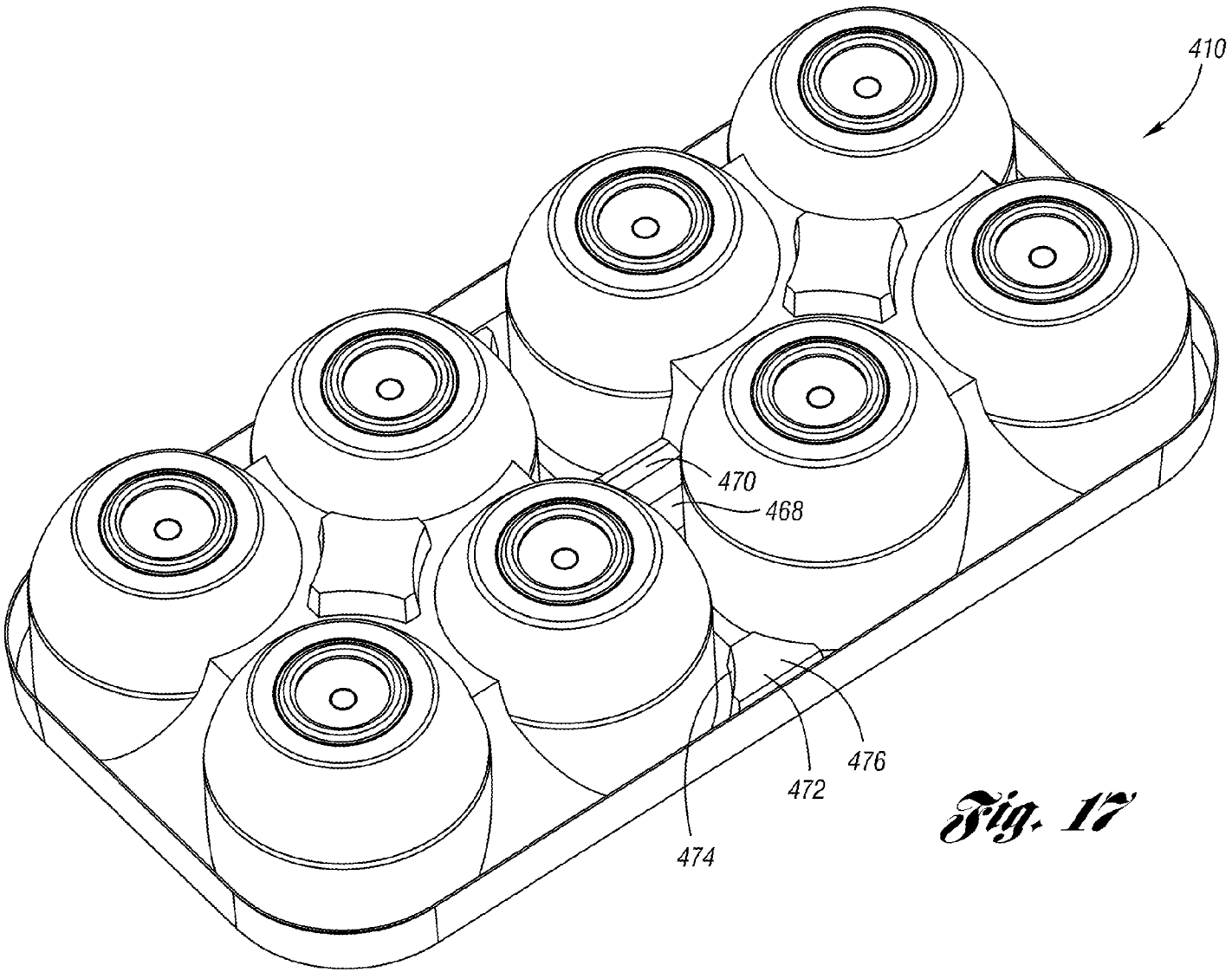
FIG. 17 is a bottom perspective view of the crate of FIG. 16.

A pair of recesses are formed in the outer portions of the upper surface 460 of the center divider 418A. These recesses 472 each include a substantially vertical peripheral walls 474 extending downward to a substantially horizontal bottom wall 476. The peripheral walls 474 provide further reinforcement to the crate 410 against bending about the axis of the center divider 418A. FIG. 17 further illustrates the recess 472.

Figure 18:
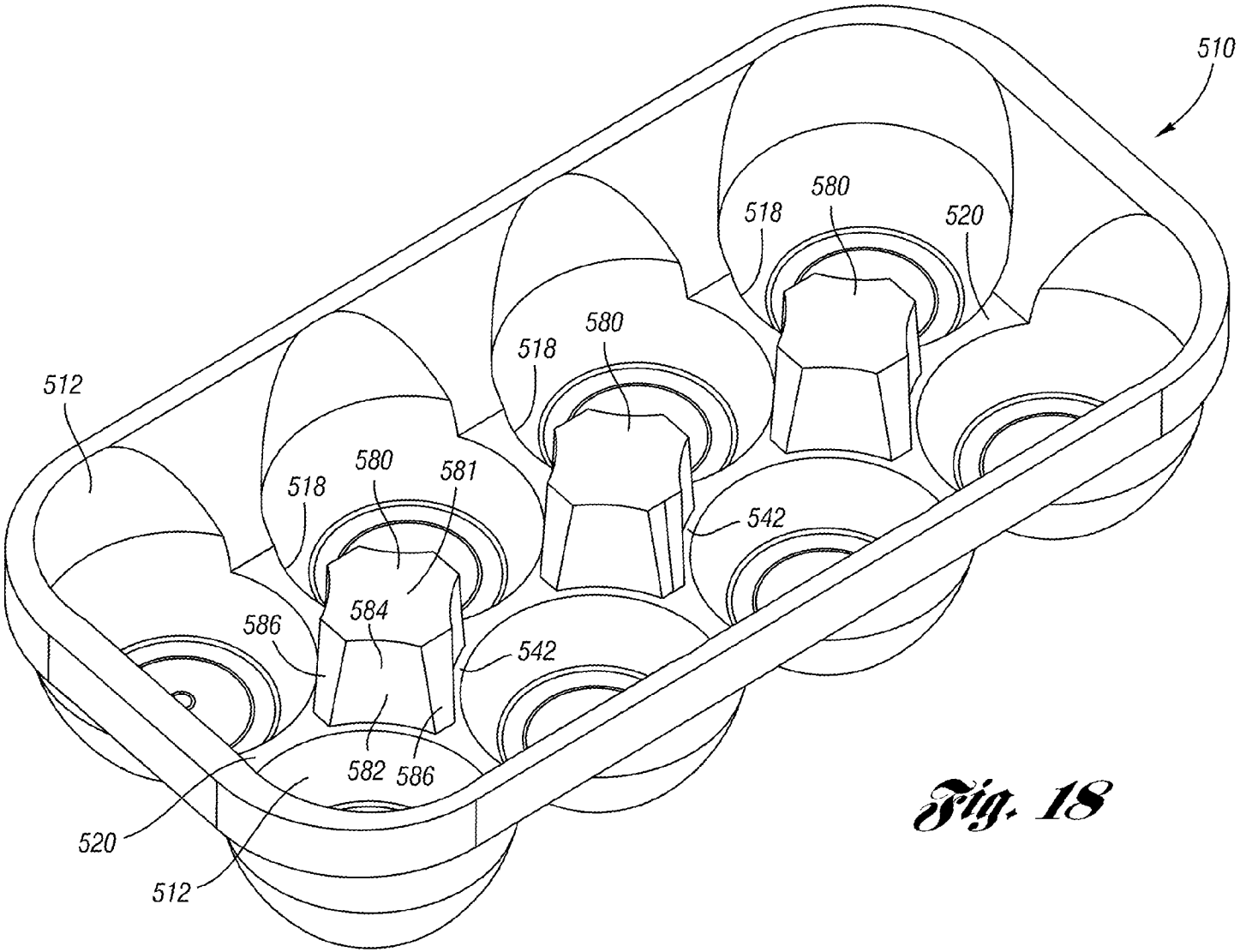
FIG. 18 is a perspective view of a crate according to a sixth embodiment of the present invention.

FIG. 18 illustrates a crate 510 according to a sixth embodiment of the present invention. The crate 510 is substantially similar to the crate 10 of FIG. 1, except as follows. The diamond shaped intersections 542 between the lateral dividers 518 and the longitudinal dividers 520 each include an upwardly projecting pylon 580 having a substantially horizontal upper surface 581 and substantially vertical (although somewhat tapered, to the extent required for thermoforming)

peripheral walls 582. The peripheral walls 582 include alternating concave portions 584 aligned with each of the pockets 512 and flat portions 586 aligned with the lateral dividers 518 and longitudinal dividers 520. The peripheral walls 582 of the pylons 580 provide additional support to the bottles in the pockets 512 and provide resistance to bending of the crate 510 about any of the lateral dividers 518 or the longitudinal dividers 520.

Figure 19:
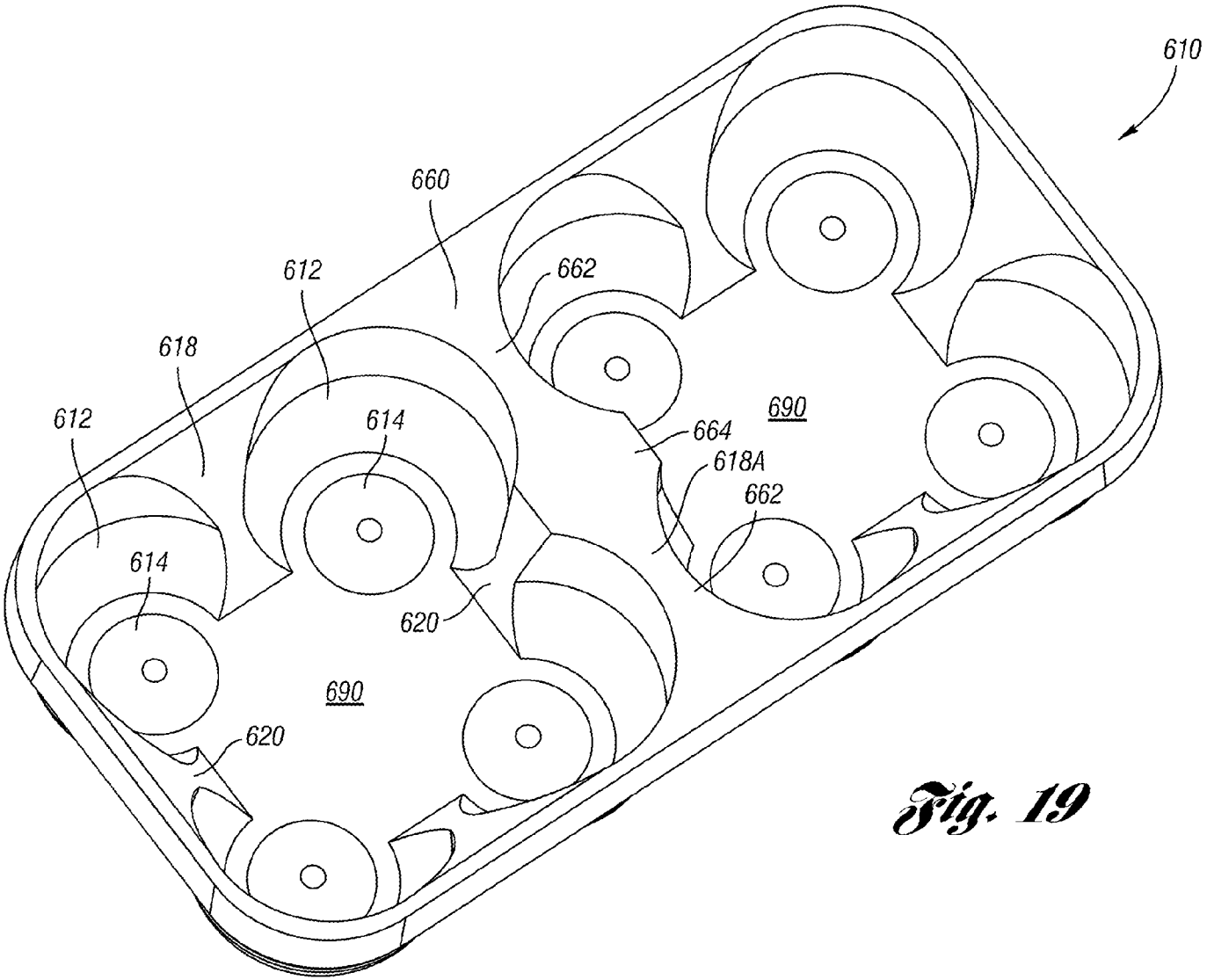
FIG. 19 is a perspective view of a crate according to a seventh embodiment of the present invention.

A crate 610 according to a seventh embodiment of the present invention is shown in FIG. 19. The crate 610 includes a center lateral divider 618A, which includes a substantially horizontal upper surface 660 having a center wider portion 664 and two narrow portions 662 aligned with the pockets 612. Optionally, the center divider 618A may be like the center divider 318A of FIG. 14 or the center divider 418A of FIG. 16.

In this embodiment, the lateral dividers 618A and longitudinal dividers 620 are truncated to leave a substantially flat, horizontal common surface 690 joining the bottom walls 614 of each of the pockets 612. The pockets 612 are oriented such that the bottles (not shown) in the pockets 612 would all be in snug contact with one another to provide strength to the loaded crate 610.

In accordance with the provisions of the patent statutes and jurisprudence, exemplary configurations described above are considered to represent a preferred embodiment of the invention. However, it should be noted that the invention can be practiced otherwise than as specifically illustrated and described without departing from its spirit or scope. Alphanumeric identifiers on method steps are for convenient reference in dependent claims and do not signify a required sequence of performance unless otherwise indicated in the claims.

What is claimed is:

1. A crate comprising:

a plurality of bottom walls each having a pocket wall extending at least partially about the periphery of the associated bottom wall defining a container pocket thereon;

a first lateral divider including an upper surface and contiguous walls extending generally transversely therefrom to resist bending of the crate around the first lateral divider, the upper surface of the first lateral divider including a wide center portion and a pair of substantially vertical contiguous walls extending downwardly therefrom, the pair of walls defining a generally perpendicular channel through the wide center portion of the first lateral divider; and an upper side wall extending upward from the pocket wall of each of the plurality of bottom walls, the upper side walls defining a peripheral wall of the crate, wherein the bottom walls, the pocket walls and the upper side walls are thermoformed from a single sheet of plastic.

2. The crate of claim 1 wherein the first lateral divider is one of a plurality of dividers contiguous with the pocket walls further defining the container pockets.

3. The crate of claim 2 wherein the bottom wall, plurality of dividers and peripheral wall all have a substantially constant thickness.

4. The crate of claim 1 wherein the peripheral wall includes a lip protruding outwardly from an upper edge of the peripheral wall.

5. The crate of claim 1 wherein the pocket walls are generally annular.

6. The crate of claim 1 storing a plurality of bottles, each of the plurality of bottles received in one of the plurality of container pockets.

7. The crate and bottles of claim 6 wherein each of the plurality of bottles is in direct contact with at least two others of the plurality of bottles.

8. The crate and bottles of claim 7 wherein the peripheral wall includes a lip protruding outwardly from an upper edge of the peripheral wall and wherein each of the plurality of bottles is in direct contact with an interior surface of the peripheral wall at the lip.

9. The crate of claim 1 further including a plurality of tabs projecting outwardly from the peripheral wall to limit nesting into a subjacent similar crate.

10. The crate of claim 2 wherein at least one of the lateral dividers is positioned between each adjacent pair of container pockets.

11. The crate of claim 1 wherein the contiguous walls extending transversely from the upper surface of the first lateral divider form scallops in an upper edge of the at least one lateral divider.

12. The crate of claim 1 wherein the contiguous walls extending transversely from the upper surface form recesses in the upper surface, the recesses further defined by a bottom wall contiguous with the contiguous walls, the contiguous walls forming a peripheral wall about the periphery of the recess.

13. The crate of claim 1 further including a generally horizontal common wall joining the plurality of bottom walls.

14. The crate of claim 1 further including a second lateral divider and a longitudinal divider, both contiguous with the pocket walls and further defining the container pockets, the second lateral divider and the longitudinal divider forming an intersection defining four of the plurality of container pockets, the intersection including an upper surface having a recess formed therein, the recess including a peripheral wall generally transverse to the upper surface.

15. The crate of claim 14 wherein the peripheral wall is generally perpendicular to the upper surface.

16. The crate of claim 15 wherein the peripheral wall extends downwardly from the upper surface.

17. The crate of claim 14 wherein the recess is generally diamond-shaped.

18. A crate comprising a single thermoformed sheet defining a plurality of container pockets having bottom walls and dividers therebetween and a peripheral lip around an upper edge of the plurality of container pockets; the plurality of dividers including a first lateral divider including an upper surface and contiguous walls extending generally transversely therefrom, the upper surface of the first lateral divider including a wide center portion and a pair of substantially vertical contiguous walls extending downwardly therefrom, the pair of walls defining a generally perpendicular channel through the wide center portion of the first lateral divider.

19. The crate of claim 18 wherein the peripheral lip protrudes generally perpendicularly from an upper edge of an outer peripheral wall of the crate.

20. The crate of claim 19 wherein the dividers each include a pair of spaced-apart walls, each defining a different one of the plurality of container pockets.

21. The crate of claim 20 wherein the dividers further each include an upper wall connecting upper edges of the spaced apart walls.

22. The crate of claim 18 storing a plurality of bottles, each of the plurality of bottles received in one of the plurality of container pockets.

23. The crate and bottles of claim 22 wherein each of the plurality of bottles is in direct contact with at least two others of the plurality of bottles.

24. The crate and bottles of claim 23 wherein each of the plurality of bottles is in direct contact with an interior surface of the peripheral lip.

25. The crate of claim 24 further including a plurality of tabs projecting outwardly from the peripheral wall to limit nesting into a subjacent similar crate.

26. The crate of claim 18 wherein each of the bottom walls includes a recess on a bottom surface thereof for receiving a bottle cap of a subjacent bottle onto which the crate is stacked.

27. The crate of claim 18 wherein the sheet does not include any reinforcement ribs.

28. The crate of claim 18 wherein the dividers include a lateral divider and a longitudinal divider further defining the container pockets, the lateral divider and the longitudinal divider forming an intersection defining four of the plurality of container pockets, the intersection including an upper surface having a recess formed therein, the recess including a peripheral wall generally transverse to the upper surface.

29. The crate of claim 28 wherein the peripheral wall is generally perpendicular to the upper surface.

30. The crate of claim 29 wherein the peripheral wall extends downwardly from the upper surface.

31. The crate of claim 29 wherein the recess is generally diamond-shaped.

32. A crate storing a plurality of bottles, the crate comprising a single thermoformed sheet defining a plurality of container pockets having bottom walls and dividers therebetween and a peripheral lip around an upper edge of the plurality of container pockets, the dividers each include a pair of spaced-apart walls, each defining a different one of the plurality of container pockets, wherein the dividers include a first lateral divider including an upper surface and contiguous walls extending generally transversely therefrom, the upper surface of the first lateral divider including a wide center portion and a pair of substantially vertical contiguous walls extending downwardly therefrom, the pair of walls defining a generally perpendicular channel through the wide center portion of the first lateral divider, each of the plurality of bottles received in one of the plurality of container pockets, wherein each of the plurality of bottles is in direct contact with at least two others of the plurality of bottles.

33. The crate of claim 32 wherein the dividers include a second lateral divider and a longitudinal divider further defining the container pockets, the second lateral divider and the longitudinal divider forming an intersection defining four of the plurality of container pockets, the intersection including an upper surface having a recess formed therein, the recess including a peripheral wall generally transverse to the upper surface.

* * * * *